US011415299B2

(12) United States Patent
Nash et al.

(10) Patent No.: US 11,415,299 B2
(45) Date of Patent: Aug. 16, 2022

(54) TEMPORARY LIGHTING SYSTEM

(71) Applicant: REL Lighting Incorporated, Traverse City, MI (US)

(72) Inventors: Timothy Nash, Traverse City, MI (US); Lowell Hill, Traverse City, MI (US)

(73) Assignee: REL Lighting Incorporated, Traverse City, MI (US)

( * ) Notice: Subject to any disclaimer, the term of this patent is extended or adjusted under 35 U.S.C. 154(b) by 0 days.

(21) Appl. No.: 17/391,545

(22) Filed: Aug. 2, 2021

(65) Prior Publication Data

US 2022/0034489 A1 Feb. 3, 2022

Related U.S. Application Data

(60) Provisional application No. 63/060,434, filed on Aug. 3, 2020.

(51) Int. Cl.

| | |
|---|---|
| ***F21V 21/04*** | (2006.01) |
| ***F21V 23/06*** | (2006.01) |
| ***F21V 21/13*** | (2006.01) |
| ***F21V 23/00*** | (2015.01) |
| ***F21Y 115/10*** | (2016.01) |

(52) U.S. Cl.
CPC ..... *F21V 21/047* (2013.01); *F21V 21/13* (2013.01); *F21V 23/005* (2013.01); *F21V 23/06* (2013.01); *F21Y 2115/10* (2016.08)

(58) Field of Classification Search
CPC ..... F21S 8/026; F21S 8/043; F21Y 2115/10; F21V 21/047; F21V 21/13; F21V 23/005; F21V 23/06; F21V 21/0885
See application file for complete search history.

(56) References Cited

U.S. PATENT DOCUMENTS

| | | | | |
|---|---|---|---|---|
| 10,408,396 | B2 * | 9/2019 | Wronski | F21V 21/048 |
| 11,280,481 | B1 * | 3/2022 | Yeats | F21S 8/026 |
| 2002/0136008 | A1 * | 9/2002 | Frei | F21S 6/001 362/249.01 |
| 2020/0025356 | A1 * | 1/2020 | Hencken | H02G 3/20 |

* cited by examiner

*Primary Examiner* — Peggy A Neils
(74) *Attorney, Agent, or Firm* — Traverse Legal, PLC

(57) ABSTRACT

A temporary lighting system having a temporary lighting assembly that is configured to readily and selectively connect to a variety of connectors on a recessed lighting assembly. The temporary lighting system disclosed herein provides significant benefits over known temporary lighting systems by providing a much more economical and efficient solution.

12 Claims, 6 Drawing Sheets

FIG. 7
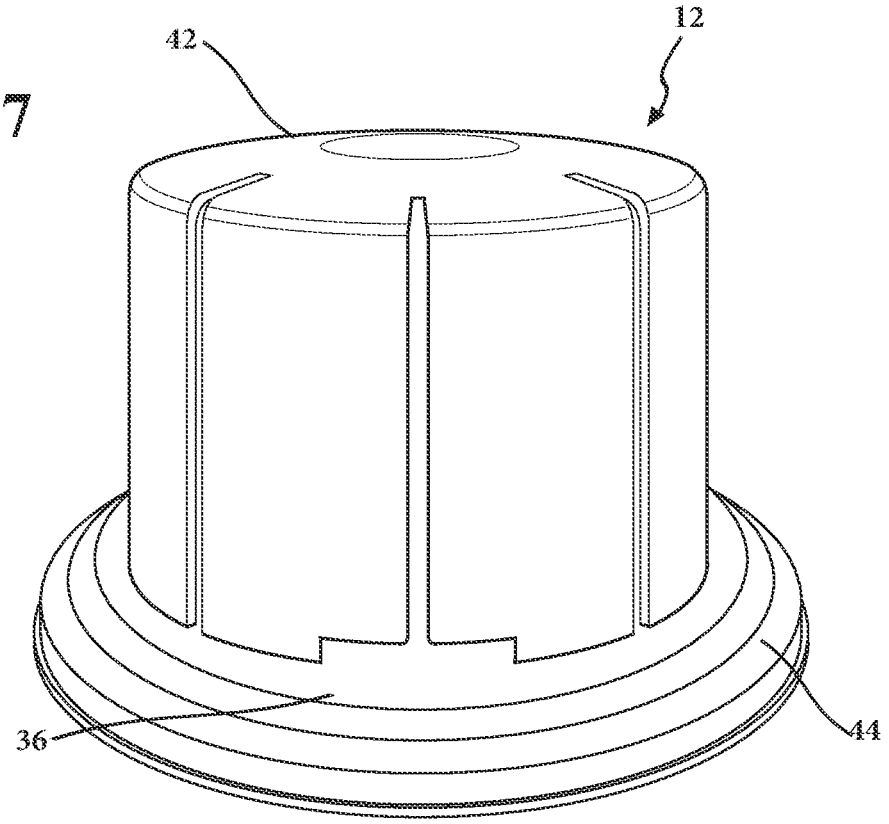
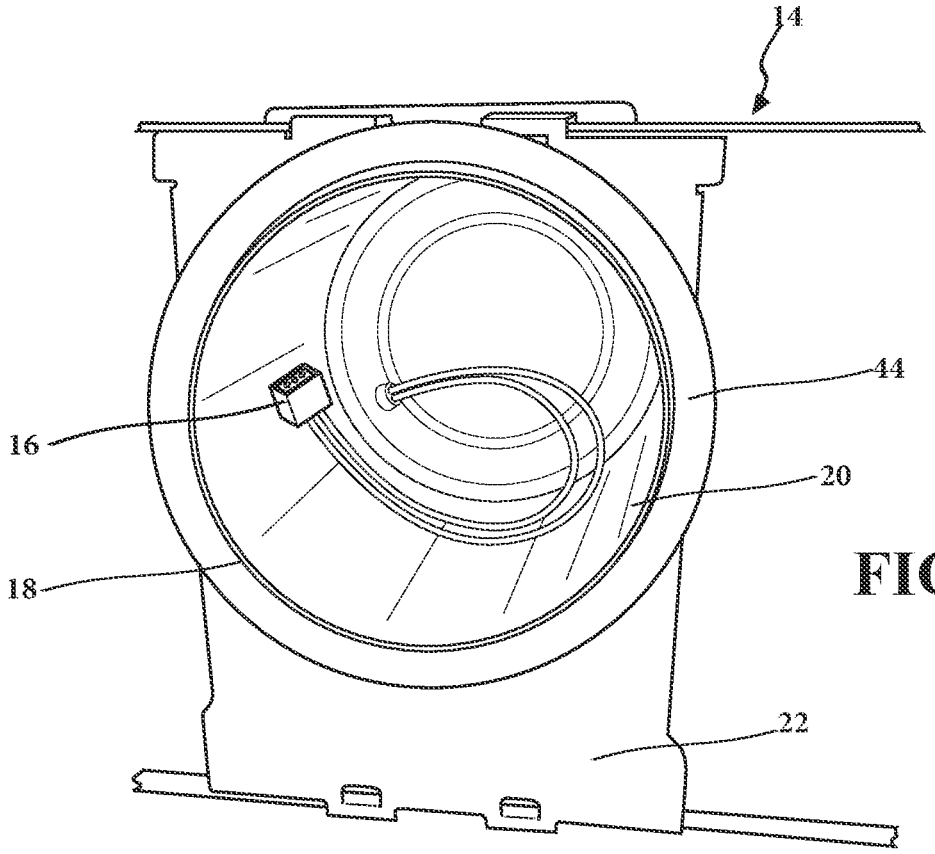
FIG. 8

TEMPORARY LIGHTING SYSTEM

CROSS REFERENCE TO RELATED APPLICATIONS

The present application claims the benefit to U.S. Provisional Patent Application No. 63/060,434 filed on Aug. 3, 2020, which is incorporated herein by reference in its entirety.

FIELD

The present disclosure relates to a temporary lighting system including a temporary lighting assembly configured to readily connect to a variety of connectors on a recessed lighting assembly.

BACKGROUND

Temporary lighting is installed on a job site for a limited amount of time to provide necessary lighting at that site. However, there are no temporary lights adapted for current recessed can lights since the temporary lights can't connect to the connectors in the recessed can lights. Most recessed can lights use a snap-like, 2-pin connector, such as a TP24 connector. Temporary lights have not been configured to connect to these types of connectors.

Instead, users have been needing to purchase finished light fixtures. Finished light fixtures also present problems in construction setting since mud, paint, and other debris get all over the fixtures. Since these fixtures are often LED lights integrated with trim and finished accents, it is very time-consuming and expensive to replace these fixtures.

Consequently, there is a need for a temporary lighting system having a temporary lighting assembly that can readily and selectively connect to a variety of connectors on a recessed lighting assembly.

SUMMARY

What is provided is a temporary lighting system having a temporary lighting assembly that is configured to readily connect to a variety of connectors on a recessed lighting assembly. The temporary lighting system disclosed herein provides significant benefits over known temporary lighting systems by providing a much more economical and efficient solution.

In an embodiment, the temporary lighting system includes a recessed lighting assembly having a housing having an opening; a can-shaped receptacle positioned within the opening of the housing, wherein the receptacle has an inner surface defining a cavity; a junction box; and an electrical connector located within the cavity of the can. The temporary lighting system also includes a temporary lighting assembly selectively connected to the recessed lighting assembly, wherein the temporary lighting assembly includes a body portion having a front side and an opposing rear side; a plurality of spaced legs, wherein one end of each of the legs is connected to the rear side of the body portion and the other end of each of the legs is in removable contact with the inner surface of the receptacle; a driver mounted on the body portion and operatively coupled with and configured to control the light output of a light source operatively interfaced therewith; and one or more wires connected at one end to the driver and at the other end to the electrical connector, wherein the wires extend through the body portion.

In some embodiments, at least one of the legs comprises a spring-loaded shaft and a tab or push button extending therefrom.

In some embodiments, the electrical connector comprises one or more luminaire disconnects, such as a TP24 connector or other type of connector commonly used by recessed lighting assemblies.

In an embodiment, a temporary lighting assembly that is configured to selectively connect to a recessed lighting assembly includes a body portion having a front side and an opposing rear side; a plurality of legs, wherein one end of each of the legs is connected to the rear side of the body portion, and wherein at least one of the legs comprises a spring-loaded shaft and a tab or push button extending therefrom; a driver mounted on the body portion and operatively coupled with and configured to control the light output of a light source operatively interfaced therewith; and one or more wires connected at one end to the driver, wherein the wires extend through the body portion.

BRIEF DESCRIPTION OF THE DRAWINGS

The above, as well as other advantages of the present disclosure, will become readily apparent to those skilled in the art from the following detailed description when considered in light of the accompanying drawings in which:

FIG. 7 illustrates a schematic perspective view of the temporary lighting assembly illustrated in FIGS. 1-6, wherein the temporary lighting assembly includes a cover; and FIG. 8 illustrates a schematic perspective view of the recessed lighting assembly illustrated in FIG. 1.

DETAILED DESCRIPTION

It is to be understood that the disclosure may assume various alternative orientations and step sequences, except where expressly specified to the contrary. It is also understood that the specific devices and processes illustrated in the attached drawings, and described in the specification are simply exemplary embodiments of the inventive concepts disclosed and defined herein. Hence, specific dimensions, directions or other physical characteristics relating to the various embodiments disclosed are not to be considered as limiting, unless expressly stated otherwise.

The present embodiments relate to a temporary lighting system having a temporary lighting assembly configured to readily and selectively connect to one or more connectors on a recessed lighting assembly. One of ordinary skill in the art would appreciate that a variety of recessed lighting assemblies having a variety of different recessed can lights with different shapes and sizes may be used with the present disclosure. Non-limiting examples include 4-10" recessed can lights used in new construction and remodel projects and in retrofit applications.

Figure 1:
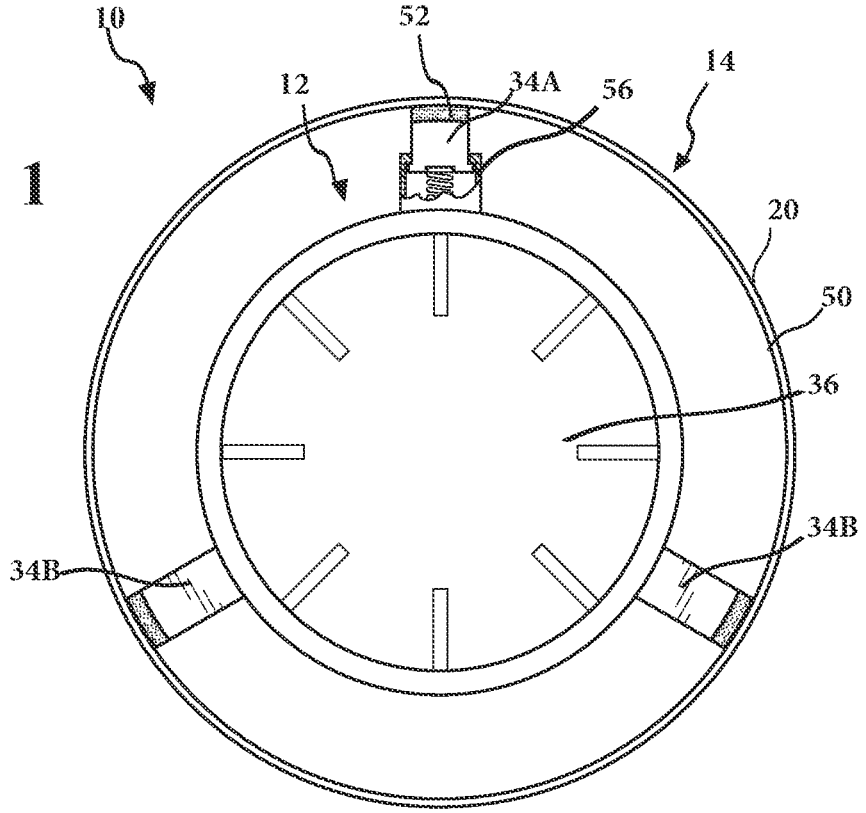
FIG. 1 illustrates a schematic top perspective view of a temporary lighting system including a temporary lighting assembly in a recessed lighting assembly according to an embodiment of the present disclosure.
Figure 2:
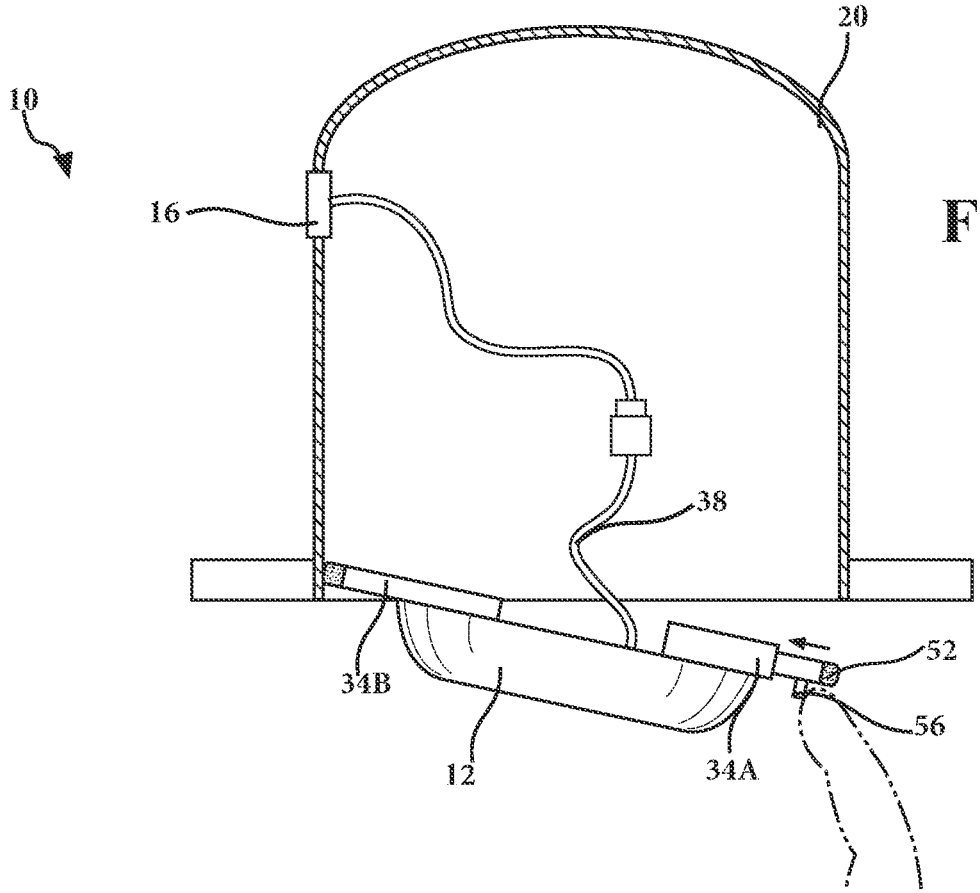
FIG. 2 illustrates a schematic exploded view of the temporary lighting system illustrated in FIG. 1.

FIGS. 1 and 2 show views of a temporary lighting system 10 including a temporary lighting assembly 12 connected to a recessed lighting assembly 14 according to an embodiment of the present disclosure. The temporary lighting assembly 12 is mounted within a can-shaped receptacle for housing a light source (a "can") 20 and is electrically connected to an electrical connector 16 on the recessed lighting assembly 14, as described in more detail below. Even though the assembly depicted in FIG. 1 is a temporary lighting assembly 12, other types of lighting assemblies may also be used with the lighting system 10 disclosed herein.

As best seen in FIG. 1 and as a non-limiting example, the temporary lighting assembly 12 is selectively attached to the can 20 via a plurality of legs 34. One end of each of the legs 34 is attached to a body portion 36 on the temporary lighting assembly 12 and the other end of each of the legs 34 is in contact with an inner surface 50 on the can 20. In an embodiment, each of the legs 34 includes a rubber tip 52 that directly contacts the inner surface 50 on the can 20. In other temporary lighting assemblies, other components may be attached to the ends of legs for attachment to inner surfaces of cans. In an alternative embodiment, some or none of the legs 34 includes a rubber tip.

Figure 4:
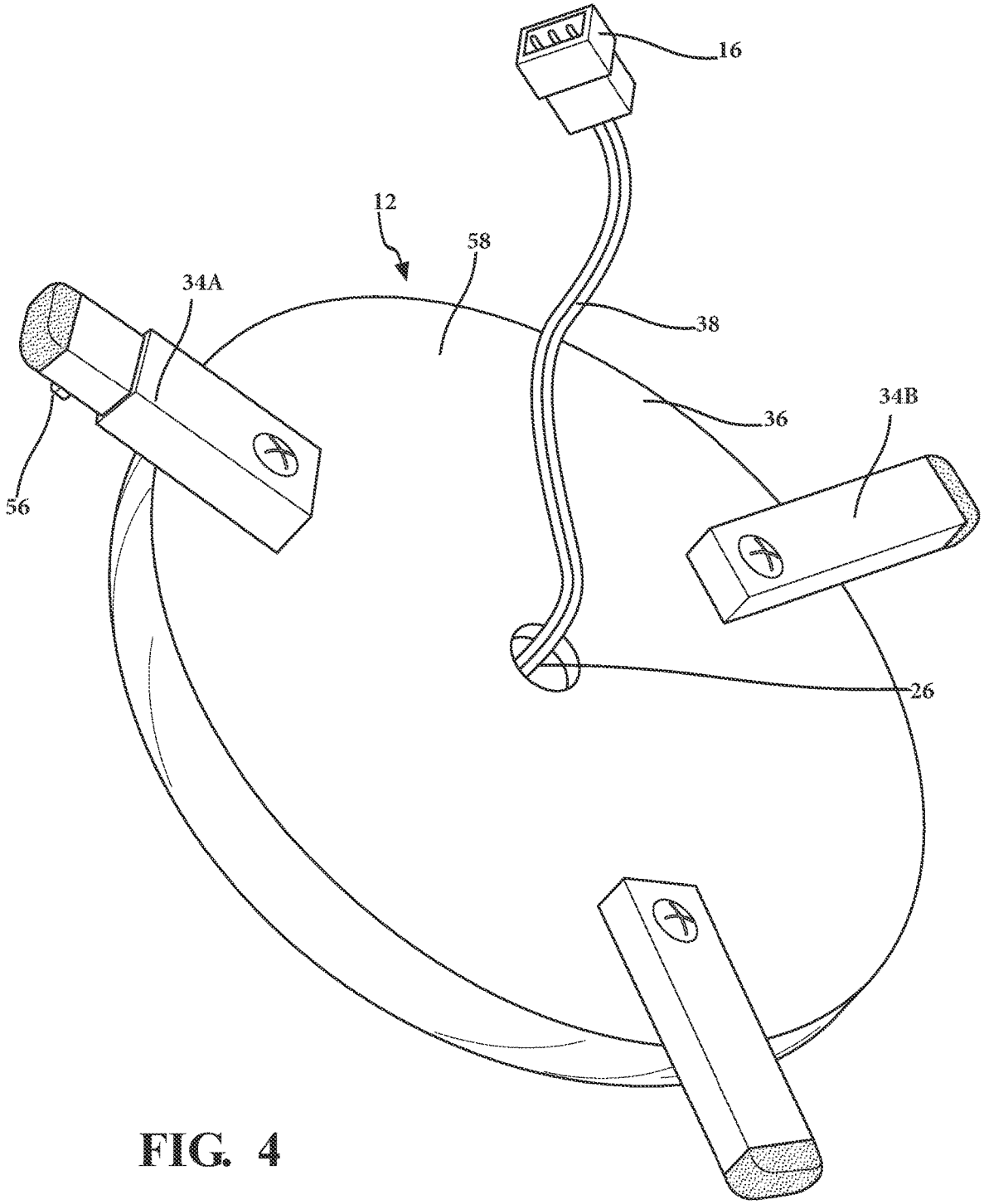
FIG. 4 illustrates a schematic rear perspective view of the temporary lighting assembly illustrated in FIGS. 1-3.

As best seen in FIGS. 1, 2, and 4 and as a non-limiting example, the temporary lighting assembly 12 includes three spaced apart legs 34, wherein one of the legs 34A is adjustable and two of the legs 34B are substantially fixed in place. The adjustable leg 34A includes a spring-loaded shaft 54 and a tab/push button 56 extending from the adjustable leg 34A. The finger tab 56 may be pressed and released by an operator's finger to engage or disengage the spring-loaded shaft 54. As a result, the adjustable leg 34A may be compressed and expanded in order to removably position and retain the temporary lighting assembly 12 in a desired location within the can 20. For example, pressing in the finger tab 56 causes the spring-loaded shaft 54 to contract allows for the temporary lighting assembly 12 to be inserted within and removed from the can 20. Releasing the finger tab 56 causes the spring-loaded shaft 54 to expand and for the adjustable leg 34A to press fit into a desired position on the can 20.

In other embodiments, temporary lighting assemblies may include either less than three legs or more than three legs. In these embodiments, the number of fixed legs and the number of adjustable legs may be altered and one or more of the adjustable legs may not include a spring-loaded shaft or a finger tab.

In an alternative embodiment, temporary lighting assemblies may include one or more hanger bars instead of legs. The hanger bars may be spring-loaded and configured to assist with inserting and retaining a temporary lighting assembly within a can on a recessed lighting assembly. The springs of the hanger bars may be selectively secured to one or more spring guides positioned within a can on a recessed lighting assembly. A portion of the hangar bars may be configured to slide in a telescoping manner to provide a desired length of the hangar bars.

Figure 3:
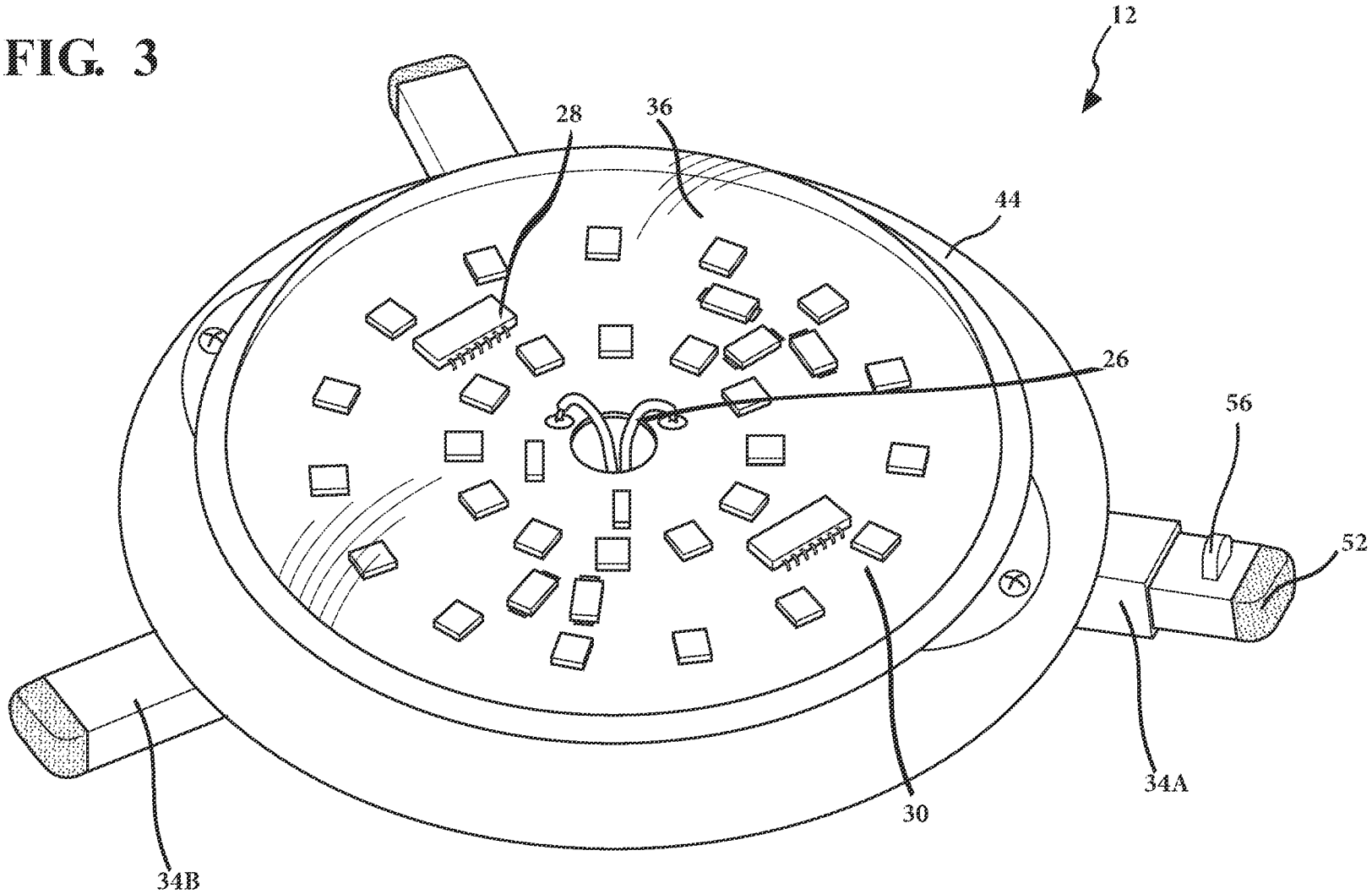
FIG. 3 illustrates a schematic front perspective view of the temporary lighting assembly illustrated in FIGS. 1 and 2.

As best seen in FIGS. 3 and 4, the temporary lighting assembly 12 comprises a driver 26 operatively coupled with and configured to control the light output of a light source 28 operatively interfaced therewith. In examples in which the power sockets are wired in series, the driver 26 may be, for example, a constant current driver. In some examples, the driver 26 is configured to adjust light color or intensity of the light source 28.

In some examples, the light source 28 may be an LED light comprising one or more LEDs mounted to a common substrate 30. The substrate 30 may comprise one or more sheets of ceramic, metal, laminate, circuit board, or another material. The substrate 30 may be electrically connected to support circuitry and/or the driver 26 for supplying electrical power and control to the light source 28. Each LED includes a chip of semi-conductive material that is used to create a positive-negative junction. The LEDs on the light source 28 may be a variety of colors.

The driver 26 and the light source 28 are mounted onto the body 36, wherein the body 36 may be made from a variety of materials, including metal. The body 36 may also have a variety of shapes and configurations. One or more wires 38 are connected at one end to the driver 26 and at the other end to the electrical connector 16 on the recessed lighting assembly 14. As best seen in FIG. 3, the body 36 is attached to an outer frame 44. The outer frame 44 may be made from a variety of suitable materials, including metal, plastic, and any combinations thereof.

As best seen in FIG. 4, a plurality of wires 38, such as a neutral wire and/or a line wire, extend from the driver 26 through the body 36. For example, the wires 38 may extend from the body 36 via one or more spacers positioned therethrough. As a result, the wires 38 may pass from one end of the temporary lighting assembly 12 to the other end.

As best seen in FIG. 4 and as a non-limiting example, each of the legs 34 is removably attached to a rear side 58 of the body 36. The legs 34 may be attached to the body 36 through a variety of joining means, such as fastening, welding, taping, gluing, or the like. For example, the legs 34 may be attached to the body 36 using one or more screws, snaps, buttons, clips, clamps, pins, straps, or the like. Similarly, the driver 26 and the light source 28 may be secured to the spacers via one or more fasteners, such as screws, nails, snaps, clips, pins, bolts, and/or other fastening devices known to one of ordinary skill in the art. The spacers may be washers and may comprise rubber.

In an embodiment, the temporary lighting assembly 12 comprises a lens that may be selectively and readily attached to one or more portions of the temporary lighting assembly 12. For example, the lens may readily snap into one or more portions of the temporary lighting assembly 12 and may be disposed of after each use of the temporary lighting assembly 12. The lens may be made from a variety of materials, including, but not limited to glass and plastic.

Figure 5:
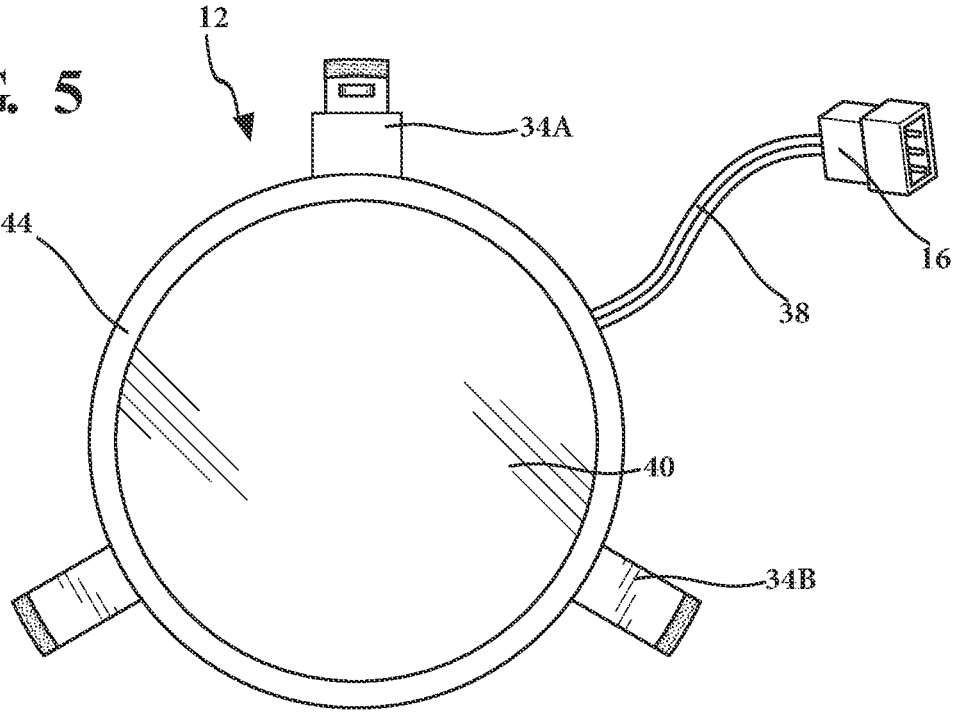
FIG. 5 illustrates a schematic top perspective view of the temporary lighting assembly illustrated in FIGS. 1-4, wherein the temporary lighting assembly includes a trim ring in a closed position.
Figure 6:
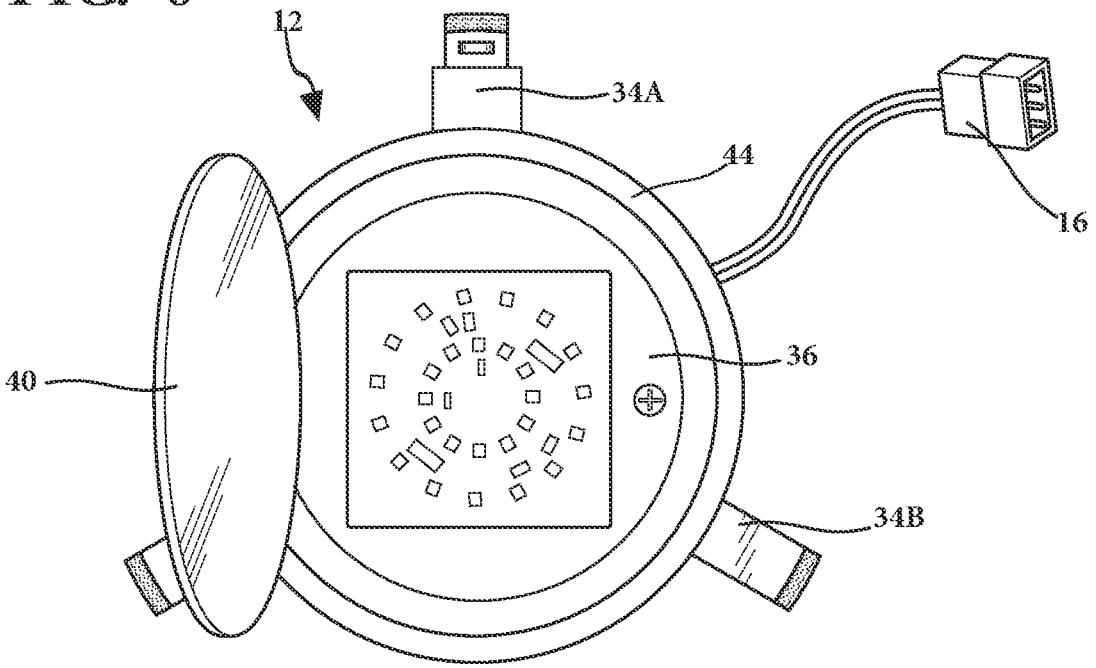
FIG. 6 illustrates a schematic top perspective view of the temporary lighting assembly illustrated in FIG. 5, wherein the trim ring is in an open position.

As best seen in FIGS. 5 and 6 and as a non-limiting embodiment, the temporary lighting assembly 12 may further comprise a trim ring 40 positioned over the top of the driver 26 and the light source 28. The trim ring 40 is attached to portions of the outer frame 44. The trim ring 40 provides an aesthetically pleasing frame of the temporary lighting assembly 12. The trim ring 40 may have any of a number of colors, shapes, textures, and configurations.

As best seen in FIG. 7 and as a non-limiting embodiment, the temporary lighting assembly 12 may further comprise a removable protective cover 42. The protective cover 42 may surround the body 36 and may be operatively connected to the outer frame 44. The protective cover 42 may be a translucent plastic or a glass enclosure.

FIG. 8 illustrates a perspective view of the recessed lighting assembly 14 illustrated in FIG. 1. The recessed lighting assembly 14 comprises housing 18, wherein the can 20 is positioned within the housing 18. The recessed lighting assembly 14 further comprises a junction box 22 and the electrical connector 16. In some embodiments, the recessed lighting assembly 14 may also comprise one or more spring guides.

The junction box 22 may be a metallic container that typically includes insulated wiring terminals for connecting external wiring to portions of the temporary lighting assembly 12. The junction box 22 may be coupled to a stud, beam, or other structural members at a work site. The junction box 22 may also act a s heat barrier to block heat emitted by the light source 28 and the driver 26.

The housing 18 on the recessed lighting assembly 14 includes a generally circular-shaped opening for receiving at least a portion of the can 20 therethrough. The can 20 may include a substantially dome-shaped member configured to receive the temporary lighting assembly 12 including at least one LED light source 28. The inner surface 50 of can 20 defines an opening for insertion of portions of the temporary lighting assembly 12. The can 20 provides an illumination pathway for the light source 28. One of ordinary skill in the art would understand that the opening on the housing 18 may have other, non-circular shapes and configurations.

The electrical connector 16 may be a variety of different types of connectors, including one or more luminaire disconnects, such as a TP24 connector or other types of connectors commonly used by recessed lighting systems. During operation of the temporary lighting system 10, the wires 38 are connected to one or more recesses of the electrical connector 16.

In an alternative embodiment, spring guides may be positioned within a can on a recessed lighting assembly. The spring guides may be configured to better retain and secure hangers on temporary lighting assemblies.

In another embodiment, the recessed lighting assembly 14 further comprises one or more magnets. The magnets may be positioned on the inner surface 50 of the can 20 or on an outer surface of the can 20.

It is to be understood that the various embodiments described in this specification and as illustrated in the attached drawings are simply exemplary embodiments illustrating the inventive concepts as defined herein.

In accordance with the provisions of the patent statutes, the present disclosure has been described to represent what is considered to represent the preferred embodiments. However, it should be noted that this disclosure can be practiced in other ways than those specifically illustrated and described without departing from the spirit or scope of this disclosure.

What is claimed is:

1. A temporary lighting system comprising:

a recessed lighting assembly comprising:

a housing having an opening;

a can-shaped receptacle positioned within the opening of the housing, wherein the receptacle has an inner surface defining a cavity;

a junction box; and an electrical connector located within the cavity of the can; and a temporary lighting assembly selectively connected to the recessed lighting assembly, wherein the temporary lighting assembly comprises:

a body portion having a front side and an opposing rear side;

a plurality of spaced legs, wherein one end of each of the legs is connected to the rear side of the body portion and the other end of each of the legs is in removable contact with the inner surface of the receptacle;

a driver mounted on the body portion and operatively coupled with and configured to control the light output of a light source operatively interfaced therewith; and one or more wires electrically connected at one end to the driver and at the other end to the electrical connector, wherein the wires extend through the body portion.

2. The temporary lighting system of claim 1, wherein the temporary lighting assembly further comprises a substrate electrically connected to the driver.

3. The temporary lighting system of claim 1, wherein the body portion is attached to an outer frame.

4. The temporary lighting system of claim 3, wherein a trim ring is positioned over the body portion and attached to portions of the outer frame.

5. The temporary lighting system of claim 1, wherein the temporary lighting assembly further comprises a protective cover surrounding the body portion and removably connected to the outer frame.

6. The temporary lighting system of claim 1, wherein the electrical connector is a TP24 connector.

7. The temporary lighting system of claim 1, wherein at least one of the legs comprises a spring-loaded shaft and a tab or push button extending therefrom.

8. The temporary lighting system of claim 1, wherein one or more of the legs includes a rubber tip at one end, and wherein the rubber tip is in direct contact with the inner surface of the receptacle.

9. A temporary lighting assembly configured to selectively connect to a recessed lighting assembly, wherein the temporary lighting assembly comprises:

a body portion having a front side and an opposing rear side;

a plurality of legs, wherein one end of each of the legs is connected to the rear side of the body portion, and wherein at least one of the legs comprises a spring-loaded shaft and a tab or push button extending therefrom;

a driver mounted on the body portion and operatively coupled with and configured to control the light output of a light source operatively interfaced therewith; and one or more wires connected at one end to the driver, wherein the wires extend through the body portion.

10. The temporary lighting assembly of claim 9, wherein one or more of the legs includes a rubber tip at one end.

11. The temporary lighting assembly of claim 9, further comprising a trim ring positioned over the body portion and attached to portions of an outer frame.

12. The temporary lighting assembly of claim 9, wherein the temporary lighting assembly further comprises a protective cover surrounding the body portion.

* * * * *